US005184439A

United States Patent [19]

Ward

[11] Patent Number: 5,184,439

[45] Date of Patent: Feb. 9, 1993

[54] PRESTRESSED LIGTHWEIGHT PANEL

[75] Inventor: Philip T. Ward, Leawood, Kans.

[73] Assignee: Western Forms, Inc., Kansas City, Mo.

[21] Appl. No.: 466,786

[22] Filed: Jan. 18, 1990

[51] Int. Cl.[5] ..... E04C 3/10

[52] U.S. Cl. ..... 52/223 R; 52/229; 52/723; 52/291

[58] Field of Search ..... 52/223 L, 223 R, 291, 52/600, 723, 309.9, 309.16, 229

[56] References Cited

U.S. PATENT DOCUMENTS 2,631,450 3/1953 Lachaise ..... 52/229
2,645,115 7/1953 Abeles ..... 52/229
2,722,721 11/1955 Carlow ..... 52/291

*Primary Examiner*—David A. Scherbel
*Assistant Examiner*—Joanne C. Downs
*Attorney, Agent, or Firm*—Wm. Bruce Day

[57] ABSTRACT

A prestressed lightweight panel is disclosed having a face sheet under tension in the longitudinal direction and reinforcing members attached to the rear side of the face sheet for locking in that tension. The panel may be rectangular and may include side rails and end rails along the edges of the face sheet, a plurality of cross-ribs for bracing or reinforcing the face sheet and a plurality of coped reinforcing sections between the cross braces. Compression resistant members, such as a honeycomb filling extend in voids between certain of the reinforcing members and the face sheet to further reduce face sheet deflection under load. The panel has a number of applications, such as for concrete forms.

17 Claims, 2 Drawing Sheets

PRESTRESSED LIGTHWEIGHT PANEL

BACKGROUND OF THE INVENTION

1. Field of The Invention

This invention relates to prestressed structural panels. More particularly, the present invention relates to a substantially planar structure having a face sheet in tension in at least one direction and a plurality of braces for maintaining the tension in the face sheet for use in a concrete form panel, among others.

2. Related Art

It is known to provide structural panels having a relatively thin face sheet that is bolstered or reinforced by one or more reinforcing members fixed to the rear side of the face sheet by means such as welding. Such panels are used in many applications, such as building walls, roofs, portable bridges, ships' hulls and so forth. In addition, a significant use for such panels is found in concrete forming systems, particularly in residential applications.

An application in concrete forming systems is found in U.S. Pat. No. 4,744,541, issued to Carlson et al. on May 17, 1988. Carlson et al. discloses a concrete form having a face sheet reinforced by a plurality of different types of reinforcement members. The face sheet has a face side that is presented to the poured concrete in the completed form, and a rear side to which the reinforcing members are fixed or attached by means such as welding. Such forms have established their value in the marketplace where they save significant amounts of labor compared with older competing forming systems, notably custom made wood forms. In addition, such forms typically lead to a superior finished concrete structure.

Such forms, however, have at least two related shortcomings. First, they are quite heavy, with a typical 3'×8' (0.9 m×2.5 m) panel weighing about 90 lbs. (41 kg.). Usually a single worker manipulates these form panels and moves them around on the job site. A lighter weight form panel could be expected to lead to increase worker productivity and fewer claims for job related injuries. Second, the pressure developed on the form panels from the hydrostatic head of the substantially fluid poured concrete and the expansion of the concrete upon setting distort the forms, causing the face sheet to bulge outwardly from the concrete in between the reinforcing members. One of the manifestations of this deformation is known as pillowing and results in a series of bulges which become increasingly pronounced from the top to the bottom of the form panel. The effect is frequently visible in the finished concrete product and detracts from the aesthetics of a formed concrete wall. Naturally, when the wall will be covered with an outer facade, such as stucco, or brick, the pillowing effect is not as important. Increasingly, however, architects are designing buildings with exposed concrete facades, sometimes molded to resemble brick or cut stone. In these applications the pillowing effect is substantially unacceptable.

Typically, solutions to these two problems are antithetical to one another. Decreasing the weight of the form reduces material costs, shipping costs, and may increase labor productivity, but leads to increased pillowing and decreased form life. In contrast, the pillowing effect can be virtually eliminated, but at the expense of considerably increasing the weight of the form panel. The increased weight of such a heavily reinforced form panel increases the cost of materials and shipping to prohibitive levels, as well as making it difficult at best for a single worker to handle the panel, leading to declines in productivity.

Accordingly, there is a need for a structural panel, such as a concrete form panel, that is both lightweight and strong enough to withstand the hydrostatic head pressure and the pressure caused by expansion of the setting concrete, of poured concrete, or other forces, and reduce pillowing between the reinforcing members.

SUMMARY OF THE INVENTION

It is, therefore, the primary object of the present invention to provide a structural panel that is lightweight and that retains the strength of much heavier panels of similar size.

It is a further object of the present invention to provide a structural panel, such as a concrete form panel, that resists the hydrostatic and expansion pressure of poured concrete, or other forces, to reduce or eliminate the pillowing effect between the reinforcement members, or other distortion.

It is a further object of the present invention to provide a panel that is lighter weight than comparable panels in the prior art.

It is a further object of the present invention to provide a panel that has an improved weight-to-strength ratio over heavier panels of the prior art.

These and other objects of the present invention are achieved by providing a substantially planar structure comprising a polygonal sheet having a x-axis and a y-axis. The polygonal sheet has a face side and a rear side and the sheet is under tension in at least one direction. A brace means for maintaining the tension in the sheet is fixed to the rear side of the sheet. The brace is typically aligned in a direction parallel to the primary direction of the tension forces in the sheet, or face sheet. For purposes of clarity, the tension will be oriented along the y-axis. The structure further comprises anti-bowing means for maintaining the sheet in a substantially flat condition by balancing the tension forces in the sheet and the counteracting compression forces in the reinforcing members. Alternatively, if desired, the anti-bowing means may be tensioned to provide a substantially flat face side on the face sheet. The anti-bowing means further comprises a spine reinforcing member disposed parallel to the y-axis and fixed to the reinforcing member or to the rear side of the face sheet itself. The tension forces in the anti-bowing means are in a direction parallel to the y-axis.

In brief summary, the face sheet is in tension along the y-axis. Fixed to the rear side of the face sheet is at least one reinforcing member in compression in a direction parallel to the y-axis. Fixed to the reinforcing member (on the rear side of the face sheet) is the anti-bowing means or spine reinforcing member, which is in tension along its longitudinal axis or centerline, with both the anti-bowing means and the tension forces in it oriented in a direction parallel to the y-axis. These and other forces are locked into the substantially planar polygonal structure during manufacture by fixing the components together while these forces are applied to the respective members in a process described below.

In no case do the stress and strain distort the respective members beyond the yield point or elastic limit of the material. Accordingly, each of the component elements of the planar structure would return to their original dimensions if the stress forces were removed. It is the characteristic urge of the materials to return to their original dimensions or rebound that locks these forces into the panel. The components cannot, however, rebound because some are locked in longitudinal tension and these forces are opposed and balanced by compression forces locked into other members or components, so that the various opposing forces are in equilibrium.

A preferred material for all these structural elements is aluminum, and the preferred means for joining the members is welding.

In an embodiment specifically designed for use as a concrete form panel, the invention comprises a rectangular panel having a face sheet under tension fixed to at least one brace means for maintaining the tension in the sheet. The brace means comprises a pair of side rails disposed along opposite long sides adjacent to the respective long edges of the face sheet, which are fixed to the rear side of the face sheet. An end rail is disposed along each of the two short sides of the panel adjacent to the respective short edges of the face sheet. A plurality of cross braces or cross-ribs is disposed throughout the length of the panel and parallel to the end rails and is fixed to the rear side of the face sheet and to the side rails by welding or other means.

Then the face sheet is put in tension in a longitudinal direction by pulling on it. A plurality of coped reinforcing members is disposed between adjacent cross braces, or cross-ribs, forming a line along most of a longitudinal centerline of the panel and additional cross braces are disposed between each end rail and the adjacent cross-rib. These cross-ribs are in compression because they are inserted while the face sheet is stretched and they are welded into place without any gaps between the coped reinforcing sections and the cross-ribs prior to releasing the tension on the face sheet and side rails.

A spine reinforcing member may then be fixed to the coped reinforcing members by welding while the spine reinforcing member is under tension along the y-axis. The spine reinforcing member maintains the face sheet in a substantially flat state. A further reinforcing member or stiffening member in compression may be applied along a direction parallel to the y-axis, such as by routing it through the cross-ribs and perpendicular to them and welding it in place against the rear side of the face sheet or to reinforcing members at two or more joints while the face sheet is under compression. Releasing the external tension from the face sheet puts the stiffening members in compression. Such additional stiffening members may be tubular.

A process for manufacturing the prestressed panel comprises deforming a flat polygonal face sheet having a face side and a rear side so that the face side is moderately concave; about the x-axis bending at least one reinforcement member to conform to the shape of a cross section of the face sheet along the line where the reinforcement member will be placed on the face sheet; fixing the reinforcing member to the rear side of the face sheet to form a panel; pulling on the panel and the reinforcing member; and maintaining the stress and strain created in the face sheet and the reinforcing member. The process further comprises fixing at least one coped reinforcing member to the rear side of the face sheet while the face sheet is in tension. Alternatively, the coped reinforcing member may be fixed to the reinforcing members while the face sheet is under tension. Then the tension is released and a prestressed lightweight panel suitable for many applications is complete.

In an alternative embodiment, the face sheet is placed under tension and the side rails are welded to the face sheet. Then the tension is released. Partial rebounding of the face sheet leaves the face sheet in tension and the side rails in partial compression, greatly strengthening the finished panel. Then other reinforcing members can be added as desired or as later described herein. In this embodiment it is not necessary to bend the sheet metal face prior to welding.

In another alternative embodiment, the process further comprises the additional steps of pulling on at least one spine reinforcing member and fixing the spine reinforcing member to the face sheet at not less than two points and then releasing the tension on the spine reinforcing member.

In the case of a rectangular shaped face sheet, a crown is formed into the face sheet about a transverse centerline or x-axis and a secondary reverse crown is formed about a longitudinal centerline. The crown and the secondary reverse crown are tapered from the respective transverse centerline and longitudinal centerline to the respective short edges and long edges of the rectangular face sheet.

These and other objects and advantages of this invention will become apparent from the following description taken in connection with the accompanying drawings wherein is set forth by way of illustration and example, an embodiment of this invention.

DESCRIPTION OF THE PREFERRED EMBODIMENT

As required by the statutes and case law, a detailed embodiment of the present invention is disclosed herein. It is to be understood, however, that the disclosed embodiment is merely exemplary of the invention, which may be embodied in various forms suited for every specific functions. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 7:
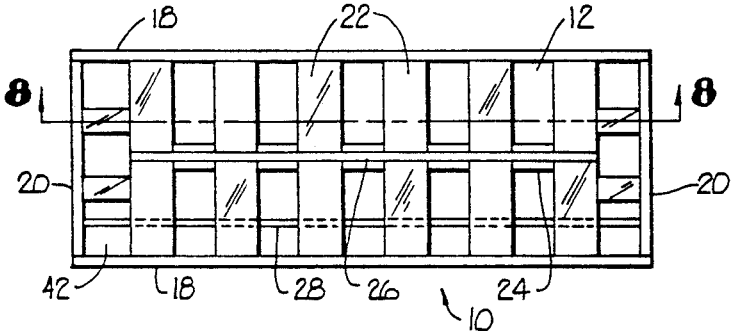
FIG. 7 is a rear plan view of the finished prestressed lightweight panel.

Referring to FIG. 7, there is shown a rear plan view of the completed prestressed lightweight panel 10. A brief description of the parts and the finished panel 10 will precede the disclosure of the process of manufacturing it. The prestressed lightweight panel 10 includes the face sheet 12 having a rear side 14 and a face side 16 (see FIG. 8). In use, the face side 16 of the face sheet 12 is subjected to the working load of whatever use is made of the panel. For example, if the prestressed lightweight panel 10 is employed in forms to receive poured concrete, the concrete will bear against the face side 16 of the face sheet 12. All reinforcing members are fixed to the rear side 14 of the face sheet 12. The reinforcing members comprise additional components of the prestressed lightweight panel 10.

Still referring to FIG. 7, the prestressed lightweight panel 10 further comprises the side rails 18, the end rails 20, a plurality of cross-ribs 22, which may number six in the preferred embodiment of a prestressed lightweight panel 10 having a face sheet 3 feet×8 feet (0.9 m×2.5 m). The prestressed lightweight panel 10 further comprises a plurality of coped reinforcing members 24 which form a column along the longitudinal centerline of the prestressed lightweight panel 10 (i.e., the y-axis, see FIG. 2). Also included is a spine reinforcing member 26. Finally, the prestressed lightweight panel 10 may further comprise one or more stiffening members 28. Each of these components will be described more thoroughly in conjunction with the process of manufacture.

Figure 2:
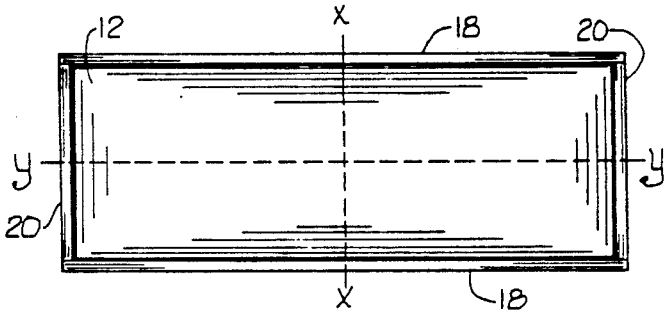
FIG. 2 is a rear plan view of the face sheet with the side rails and end rails attached.

Referring to FIG. 2, there is shown a rear plan view of the face sheet 12 illustrating the y-axis and the x-axis. The y-axis lies along the the longitudinal centerline of the rectangular face sheet 12, and naturally, also along the longitudinal centerline of the finished prestressed lightweight panel 10. The x-axis lies perpendicular to the y-axis and in the same plane, consisting of a line lying along the transverse centerline of the face sheet 12 and the finished prestressed lightweight panel 10. The x-axis and y-axis are useful in describing the directions of various forces that are applied to the components during manufacture of the prestressed lightweight panel 10 and that are locked into the finished product. These internal forces account for the improved performance of the prestressed lightweight panel 10 relative to unstressed panels. In use, the prestressed lightweight panel 10 designed for use in pouring concrete into forms would typically be fastened to adjacent panels and would be standing vertically on the narrow or short side of the rectangular form. In use, therefore, the panel would normally be oriented such that the y-axis is vertical and the x-axis is horizontal.

Figure 1:
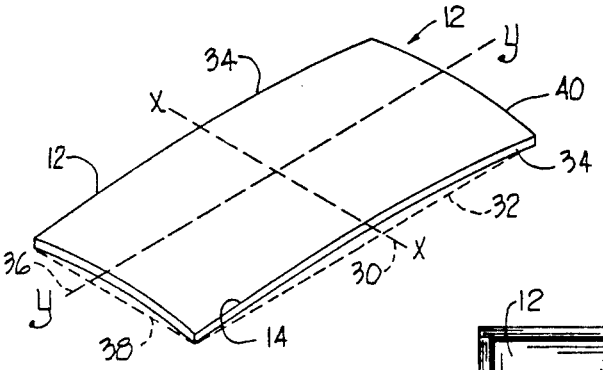
FIG. 1 is a perspective view of the face sheet of the prestressed lightweight panel at the first step of the manufacturing process.

The process of manufacturing the prestressed lightweight form panel 10 includes sequential steps that are illustrated sequentially in the drawing Figures. Referring now to FIG. 1, there is shown the face sheet 12 with the rear side 14 or back visible. The face sheet 12 is deformed by bending it to form a crown having its highest point along the x-axis. The deviation from a straight line caused by this crown 30 can be seen by comparing the path of the dotted straight line 32, which indicates the shape of the long edge 34 of the face sheet 12 prior to formation of the crown 30. Similarly, a reverse secondary crown 36 lies along the y-axis with the face sheet 12 being bent upward from the secondary reverse crown 36 as viewed in FIG. 1 by about $\frac{1}{8}$ inch (0.31 cm), that is, the long edges of the face sheet are bent upward as illustrated in FIG. 1 by $\frac{1}{8}$ inch (0.31 cm). In the preferred embodiment, the taper from the crown 30 to the short edges 40 of the face sheet 12 is uniform about the x-axis and the taper of the secondary reverse crown 36 is uniform from the y-axis to each of the long edges 34 of the face sheet 12. These two crowns peaking in two opposite directions cause formation of certain complex curves of moderate dimensions.

In the preferred embodiment, the face sheet is 3'×8'×38 gauge (0.080 inches thick) (0.9 m×2.5 m×0.20 cm) aluminum sheeting such as 5086 aluminum alloy. A considerable amount of welding onto the face sheet 12 takes place during the process.

Much of the welding, particularly the initial welding, is performed on a temperature controlled table to quickly conduct excess heat away from the weld to improve the quality of the weld and its strength and to minimize warping. The temperature controlled table (not shown) includes a form having the crown and secondary reverse crown formed into the table top and copper sheathing or cladding covering the form to provide a heat sink. Temperature controlled water is run through a series of pipes in contact with the copper top of the table and through a rubber bladder around the perimeter of the bed or table top. The temperature and flow rate of the water are controlled to prevent warping of the face sheet 12.

The copper and temperature controlled table top also include a number of holes that are connected to a source of vacuum which allow vacuum to be pulled against the face sheet 12. The force generated by air pressure pulling against the vacuum is sufficient to conform the face sheet to the shape of the table top and reduces heat build up. The face sheet is not otherwise subjected to stress. The vacuum is maintained through the stage of manufacture illustrated in FIG. 3, that is, until the side rails 18, end rails 20, and cross-ribs 22 are welded in place on the rear side 14 of the face sheet 12.

Referring to FIG. 2, the two end rails 20 and the two side rails 18 are laid down along the edges of the face sheet 12 as illustrated. All four of the rails 18, 20 are then clamped to the face sheet 12 and the table top with sufficient force to bend them to conform with the curvatures resulting from the crown 30 and the secondary reverse crown 36. The rails 18, 20 are aluminum bar stock. The end rails are approximately $\frac{3}{8}$"×2×3' (0.95 cm×5 cm×2.4 m). Then the side rails are approximately $\frac{3}{8}$"×2"×8'. The rails 18, 20 are welded to the face sheet 12 with weld beads that will not interfere with the placement of subsequent reinforcing members.

Figure 3:
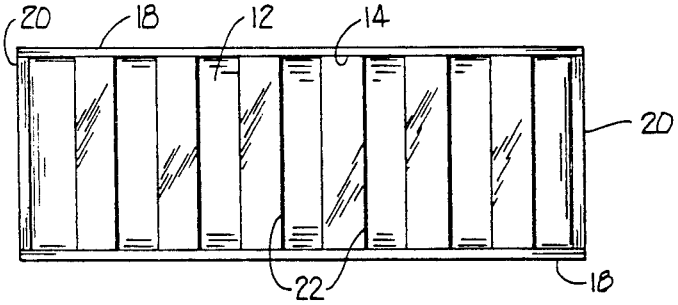
FIG. 3 is a rear plan view of the prestressed lightweight panel of FIG. 2 with the cross-ribs attached.
Figure 8:
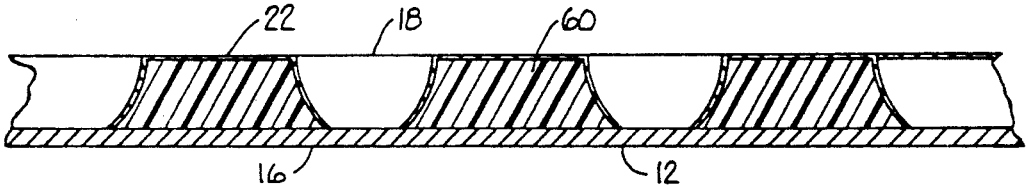
FIG. 8 is a fragmentary cross sectional view taken along lines 8—8 of FIG. 7.

Referring to FIG. 3, six cross-ribs 22 are equally spaced throughout the length of the face sheet 12 such that the length of the space between an end rail 20 and the adjacent cross-rib 22 is the same as the length of the spaces between adjacent cross-ribs 22 and all have longitudinal axes that are oriented parallel with the x-axis. That is, the cross-ribs 22 are longitudinally oriented parallel to the end rails 20 and perpendicular to the side rails 18, and lie substantially in the same plane as the rails 18, 20. The cross-ribs 22 are also made of aluminum and have a slightly arcuate cross section as best seen in FIG. 8. The cross-ribs 22 are bent sheet metal in the preferred embodiment, although greater strength could be achieved by using heavier gauge metal or solid bars. The cross-ribs 22 may be bent or bowed into place to conform with the secondary reverse crown 38 by clamping them to the temperature controlled table top, although they may also be straight. Then they are welded in place.

Figure 4:
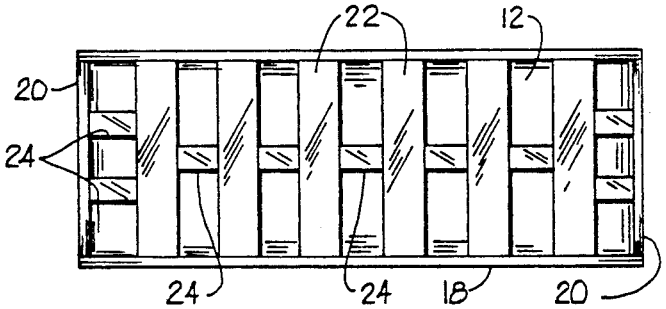
FIG. 4 is a rear plan view of the prestressed lightweight panel of FIG. 3 with the addition of the coped reinforcing members.

Referring to FIG. 4, the next step in the manufacturing process results in the unfinished panel shown in FIG. 4. To achieve the stage of manufacture shown in FIG. 4, the unfinished panel shown in FIG. 3 is stretched by placing it on a stretcher table and activating a plurality of clamps, such as six, that clamp with compression force on both sides of the face sheet 12 and also pull against the end rails 20. For example, one compressive clamp may be placed substantially in each of the four corners of the face sheet 12. The clamps are tightened and then the incomplete panel shown in FIG. 3 is subjected to pulling stresses, or in other words is put into tension by pulling in a direction parallel to the y-axis with a force of 25,000 to 45,000 lbs. (11,400 to 2,050 kg). This force is distributed in directions and planes other than the pulling direction in a complex pattern, but the result of the pulling is to stretch the side rails 18 and the face sheet 12 about 1/16 inch (0.158 cm), although well within the linear range of the stress-strain curve and well short of the elastic limit or yield point of the metals. Conventional hydraulic expansion devices are used to put the incomplete panel of FIG. 3 under tension.

While the incomplete panel of FIG. 3 is under this tension, brace means are inserted between the cross-ribs 22 to fill the spaces between the cross-ribs and thereby prevent the face sheet 12 from returning to its original dimensions even after the hydraulically generated external tension forces are removed. In the illustrated example, nine reinforcing members 24 are set in place and welded to the adjacent and perpendicular members. The reinforcing members are disposed in one or more straight lines parallel to the y-axis and intermediate of the two long sides or other boundary edge of a face sheet. It is important that there is no gap between the reinforcing members 24 and the adjacent elements to which they are welded when the welding is completed, so the reinforcing members 24 are coped to fit closely into their intended spaces. As illustrated in FIG. 4, the coped reinforcing members are shaped to conform snugly with the contour of the adjacent adjoining members when the incomplete panel of FIG. 3 is in the stretched condition and any possible remaining gap is welded closed.

Still referring to FIG. 4 in particular, the coped reinforcing members 24 are disposed in a line along the longitudinal centerline, or y-axis of the face sheet 12 and are in contact with the face sheet 12 as well as the adjoining members that project outwardly from the rear side 14 of the face sheet 12. Adjacent to each end rail 20, however, there are two coped reinforcing members 24 spaced apart to divide the width of the face sheet 12 into thirds. Although it is possible and workable to include only a single coped reinforcing member 24 in these two end channels 42 that are formed toward the short edges of the panel 12, it has been found that the additional reinforcement provided by having a second coped reinforcing member 24 at each end of the finished prestressed lightweight panel 10 provides a more rigid face sheet 12 at the points where the greatest hydrostatic pressure will be developed, namely, at the bottom of the form (either end being capable of serving as the bottom of the form). When the weld beads and all elements have solidified, the external tension forces are removed.

Strain gauge measurements reveal that the tension remaining in the face sheet 12 after all clamps and tensioners have been removed from the panel of FIG. 4 is at least about 2,000 lbs. (900 kg) in a direction parallel to the y-axis. It is believed that the coped reinforcing members are now in compression and lock in the stress and strain of the face sheet 12 that was caused by the tension forces applied in the preceding step. It is apparent that only a portion of the total force remains locked into the panel 10 using the process described to the point. Additional potential tension in the face sheet can be realized as actual tension in subsequent steps that add the spine reinforcement member 26, as disclosed below.

Figure 5:
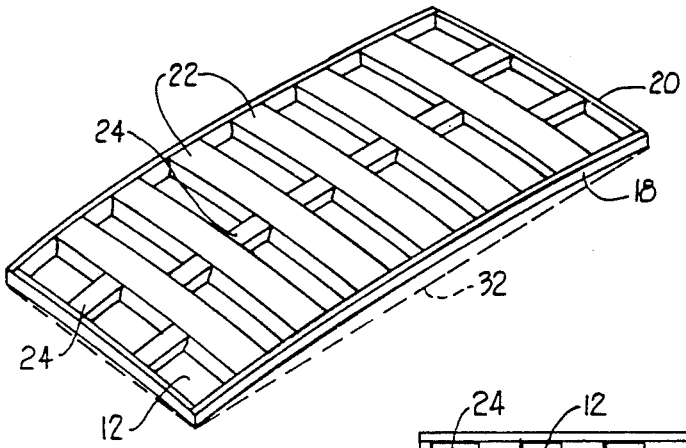
FIG. 5 is a perspective view of the prestressed lightweight form panel of FIG. 4 illustrating the concave shape of the face sheet at this stage of the manufacturing process.

At this point, the panel as shown in FIG. 4 still maintains a shape similar to the shape of the face sheet shown in FIG. 1, that is, both the crown 30 and the secondary reverse crown 36 remain in the panel, although they are not as pronounced as before the tension forces were applied because those forces tend to flatten the sheet and to remove at least a portion of the crown 30. That is, the face side 16 of the face sheet is still slightly bent toward the face side along the narrow ends of the panel as illustrated in FIG. 5 where the curvature is exaggerated for purposes of illustration. The panel thus formed is complete and is suitable for many applications.

Figure 6:
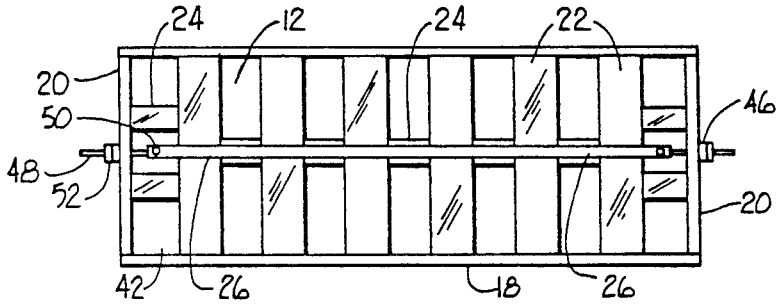
FIG. 6 is a rear plan view of the prestressed lightweight panel illustrating application of the spine reinforcing member.

Referring now to FIG. 6, there is shown an additional step that is performed in the manufacture of an alternative embodiment of a prestressed lightweight panel 10 intended for use in heavy load applications. In this embodiment, an anti-bowing means, such as the spine reinforcement member 26, is attached to the rear side 16 of the face sheet 12 to prevent the panel, and especially the face sheet 12, from bowing, i.e., becoming more concave when subjected to heavy loads.

A spine reinforcing member 26 consisting of a length of aluminum bar stock is disposed along the y-axis and connected to a stop 46 by the rod 48 and the fastener 50. The rod 48 is passed through an aperture in the right-hand end rail 20. The left-hand end rail 20 also includes an aperture through which a rod 48 is passed, the other end of the rod being attached to the spine reinforcing member by the fastener 50. A stop and hydraulic expander 52 is attached to the end of the left-hand rod 48. At this point, the spine reinforcing member 26 lies loosely along the coped reinforcing members 24 and the cross-ribs 22. A pair of clamps, one located on each side rail 18 where they are intersected by the x-axis, clamps the face sheet 12 firmly to the table top to insure the panel will bend in the desired direction only. The stop and hydraulic expander 52 is activated creating tension forces in the spine reinforcing member 26 parallel to the y-axis, until the face side 16 of the face sheet 12 flexes or bows and becomes substantially flat in side elevation. That is, the curvature illustrated in exaggerated form in FIG. 5 is removed. When the face sheet 12 is substantially flat no additional force is applied through the stop and hydraulic expander 52, but the tension then in the spine reinforcing member 26 is maintained. If desired, the face sheet 12 may be bent a little beyond a flat state so that it has a longitudinal convexity of about ⅛ inch (0.318 cm), which will be removed by the tension in the face sheet 12, which slightly stretches the welded spine reinforcement member 26, so that the finished panel 10 is substantially flat. Installing the spine reinforcement member 26 increases the tension in the face sheet 12 by about 2,000 lbs. (900 kg), for a total locked in tension of about 4,000 lbs. (1,800 kg). Thus the embodiment of the prestressed lightweight panel 10 having the spine reinforcement member 26 is stiffer and less subject to deflection than the embodiment that does not include it. Then the spine reinforcing member 26 is welded to the coped reinforcing members 24 and the weld beads are allowed to cool. It is important that the spine reinforcing member 26 be welded at each weldment sequentially from one end to the other.

Then the stop 48 and the stop and hydraulic expander 52 are removed, along with the rods 48 and the fasteners 50. If desired, the apertured tab ends of the spine reinforcing member 26 that were attached to the pulling apparatus can be cut off to provide a superior finished appearance. The final completed prestressed lightweight panel 10 is shown in FIG. 7.

It is believed that the primary forces now acting within the prestressed lightweight panel 10 include tension forces and stress and strain within the face sheet 12 primarily oriented in directions parallel to the y-axis; some tension forces parallel to the length of the side rails 18, particularly in those portions of the side rails 18 closest to the rear side 14 of the face sheet 12; compression forces in the side rails 18, particularly in the portions farthest from the face sheet 12, which are trying to return to their original straight shape; compression forces in the coped reinforcing members 24, which were inserted and fixed into place when the face sheet 12 was stretched and which apparently lock in much of the remaining tension forces found in the face of the finished prestressed lightweight panel 10. Finally, in the preferred embodiment that includes the spine reinforcement member 26, tension forces in the spine reinforcement member directed substantially parallel to and along the y-axis remain in the member 26 after manufacture. It has been found that the resulting finished prestressed lightweight panel 10 is dimensionally stable, indicating that these counter-acting forces are in equilibrium.

In use, when the poured concrete or other external vector exerts a force against the face side of the face sheet, that force must compress the side rails 18, which are already in compression, and the spine reinforcement member 26, which is in tension, before the face sheet 12 itself can be deflected.

In an alternative embodiment that may use even lighter weight materials for some members, the panel may include one or more stiffening members 28, as shown in FIG. 7. The stiffening member 28 is preferably an aluminum pipe pushed through apertures drilled in the side walls of the cross-ribs 22, and welded at each joint, that is, where the stiffening member 28 penetrates a coped reinforcing member 24. The stiffening member 28 is welded to the face sheet 12 while the panel is stretched longitudinally, that is, at the stage of the process shown in FIG. 4. Upon release of tension in the panel, the member 28 is placed in compression and resists the tendency of the panel to rebound. One or more stiffening members 28 may be used in conjunction with or in lieu of the coped reinforcement members 24. Naturally, other means of further stiffening the resulting structure can be developed. It would be simple enough, for example, to employ more than one spine reinforcing member 26.

In an alternative embodiment, a flat face sheet 12 is pulled in tension along the y-axis and a pair of side rails 18 comprising a brace means are placed along the edges of sheet 12 that are parallel to the y-axis. While the face sheet is being pulled, the side rails are welded to the face sheet. Additional longitudinal members may also be welded to the face sheet while it is under tension. The tension is put into the face sheet 12 by pulling on it in directions parallel to the y-axis with a force of 25,000–45,000 lbs. (11,400–2,050 kg). Each side rail is welded to the face sheet in a number of places and the welds must be laid down sequentially from one end of each side rial 18 to the other to lock the tension forces into the face sheet 12. When the welds have solidified and cooled, the external tension forces can be released from the face sheet 12. Then the face sheet 12, which has been stretched, but not beyond its elastic limit, tends to rebound because for the sheet 12 to shorten, the side rails 18 would also have to become shorter. Thus the tension forces in the sheet 12 place the side rails 18 in compression and the two opposing forces cancel each other and permit no significant dimensional change in any member.

Naturally additional members, such as cross-ribs, reinforcement members, spine reinforcement members, or stiffening members could also be added to the prestressed lightweight panel of this alternative embodiment.

As a further aid to preventing or significantly reducing deformation of the face sheet 12 when under load, such as the hydrostatic loading of poured concrete and the additional loading that results when the concrete expands as it sets, compression resistant structural members of particularly lightweight and light resistance to compression may be positioned between the face sheet 12 and structural members backing the face sheet 12, such as the cross-ribs 22 and the reinforcing members 24. In the illustrated example, the cross-ribs 22 are of cross sectional hat shape and form a void against the face sheet. The area of the face sheet 12 within the ribs 22 and between the ribs 22 is subject to the localized bulging, called pillowing.

To combat this pillowing, the void is filled with a compression resistant material, such as a high strength plastic foam, aluminum composite honeycomb, or as shown in the illustrated example, a resin impregnated kraft paper based honeycomb shape 60. Alternatively, the void may be filled by an injectable mix of expanding chemicals to cure into a compression resistant foam to resist the pillowing phenomena under the ribs 22.

While it is known in the prior art to employ a weak foam as a void filling to seal against entrance of extraneous concrete when used in a concrete form, such void fillings do not provide a resistance against deformation.

In operation, the prestressed lightweight panel 10, when designed for use as a concrete form, is subjected to loading of 1,000 to 1,200 lbs. per square foot (420–506 $kg/m^2$) at the bottom of an 8 foot (2.4 m) panel, loadings that are extremely typical and common in pouring foundations for houses. In such circumstances the prestressed lightweight form panel 10 shows much less deflection and maintains its degree of flatness better than unstressed panels. In addition, the panel 10 described herein weighs 73 lbs. (33 kg), approximately 20 lbs. (14 kg) lighter than the average form panel in the concrete industry.

Additionally, use of the above described process of manufacture enables production of a substantially flat faced form panel of 0.080" aluminum skin. Heretofore, such an unpretensioned thickness of skin, under conventional production methods could not be made sufficiently flat for commercial acceptance. For example, the disclosed method of manufacture permits construction of a concrete form panel with 0.080" face sheet thickness having a deviation from absolute flatness of 41% less than the deviation from absolute flatness of a unpretensioned form panel of 0.080" face sheet thickness. Not only does the disclosed method of manufacture enable practical production of such a thin sheet form panel, but the form panel is surprisingly stronger and more resistant to deflection under load than an unpretensioned panel. Engineering calculations reveal that an unpretensioned form panel of 0.080" face sheet thickness has approximately two times the deflection under a 1900 p.s.f. hydrostatic load than a form panel having the same thickness of face sheet and under a 4,000 pretension.

In the other measurements using a pretensioned concrete form panel of 0.094 face sheet thickness and a honeycomb void filling shape resistant to compression, it was determined that the subject structure had only 27% of the lateral deflection and 49.4% of the longitudinal deflection of an unpretensioned form panel without honeycomb. Accordingly, the pretensioned structure with compression resistant void filling represented a significant improvement in strength.

It is to be understood that while certain forms of this invention have been illustrated and described, it is not limited thereto, except and insofar as such limitations are included in the following claims.

What is claimed and desired to be secured by Letters Patent is as follows:

1. A panel comprising:

a) a rectangular face sheet having two opposed parallel long edges and two opposed parallel short edges, and a longitudinal y-axis comprising a centerline, said sheet under tension in a longitudinal direction, said face sheet having a face side and a rear side;

b) two side rails mounted on and fixed to said rear side of said face sheet with one said side rail adjacent to each said long edge of said face sheet;

c) brace means for maintaining tension in said face sheet: and d) said brace means comprising a plurality of reinforcing members lying between and fixed to adjacent cross-ribs.

2. A panel as claimed in claim 1 wherein said reinforcing members are aligned in a column along said centerline of said rectangular face sheet.

3. A panel as claimed in claim 2 wherein said reinforcing members are under compression, thereby acting to maintain the tension forces in said face sheet.

4. A panel as claimed in claim 1 wherein said brace means further comprises a spine reinforcement member in compression fixed to said rear side of said face sheet.

5. A panel as claimed in claim 1 wherein said brace means further comprises at least one stiffening member under longitudinal compression penetrating each said cross-ribs and fixed thereto.

6. A prestressed panel comprising:

(a) a rectangular face sheet having a face side and a rear side, two parallel opposed long edges and two parallel opposed short edges, a longitudinal centerline, and longitudinal directions parallel to said long edges, said face sheet being in tension along at least one said longitudinal direction;

(b) two side rails mounted on and fixed to said rear side of said face sheet with one said side rail adjacent to each said long edge of said face sheet;

(c) two end rails mounted on and fixed to said rear side of said face sheet with one said end rail adjacent to each said short edge of said rectangular face sheet;

(d) a plurality of cross-ribs mounted on and fixed to said rear side of said face sheet and oriented perpendicular to and in substantially the same plane as said side rails;

(e) a plurality of reinforcing members forming a column along said longitudinal centerline of said rectangular face sheet, said reinforcing members lying between and fixed to adjacent said cross-ribs, with one said reinforcing member lying between each said end rail and the adjacent said cross-rib; and (f) at least one spine reinforcement member in tension fixed to said reinforcement members.

7. A panel as claimed in claim 6 wherein said side rails and said reinforcing members are in compression.

8. A panel as claimed in claim 7 further comprising at least one stiffening member in compression routed through and fixed to said cross-ribs along said longitudinal direction.

9. A panel as claimed in claim 8 wherein said stiffening member is tubular.

10. A substantially planar structure comprising:

a) a polygonal sheet having an x-axis and a y-axis, and a face side and a rear side, said sheet being under tension in at least one direction; and b) brace means for maintaining said tension in said sheet fixed to said sheet;

c) wherein said tension comprises tension forces in a direction parallel to said y-axis of said polygonal face sheet and said brace means further comprises at least one reinforcing member disposed parallel to said y-axis and fixed to the rear side of said face sheet;

d) said reinforcing member being under compression in a direction parallel to said y-axis;

e) anti-bowing means for maintaining said sheet in a substantially flat condition;

f) said anti-bowing means comprising a spine reinforcing member disposed parallel to said y-axis and fixed to said rear side of said face sheet.

11. A substantially planar structure comprising:

a) a polygonal sheet having an x-axis and a y-axis, and a face side and a rear side, said sheet being under tension in at least one direction, and b) brace means for maintaining said tension in said sheet fixed to said sheet;

c) wherein said tension comprises tension forces in a direction parallel to said y-axis of said polygonal face sheet and said brace means further comprises at least one reinforcing member disposed parallel to said y-axis and fixed to the rear side of said face sheet;

d) said reinforcing member being under compression in a direction parallel to said y-axis;

e) anti-bowing means for maintaining said sheet in a substantially flat condition;

f) said anti-bowing means comprising a stiffening member fixed to said rear side of said face sheet.

12. A substantially planar structure comprising:

a) a polygonal sheet having an x-axis and a y-axis, and a face side and a rear side, said sheet being under tension in at least one direction, and b) brace means for maintaining said tension in said sheet fixed to said sheet;

c) wherein said tension comprises tension forces in a direction parallel to said y-axis of said polygonal face sheet and said brace means further comprises at least one reinforcing member disposed parallel to said y-axis and fixed to the rear side of said face sheet;

d) said reinforcing member being under compression in a direction parallel to said y-axis;

e) anti-bowing means for maintaining said sheet in a substantially flat condition;

f) said anti-bowing means comprising a stiffening member fixed to said reinforcing member.

13. A panel comprising:

a) a rectangular face sheet having two opposed parallel long edges and two opposed parallel short edges, and a longitudinal y-axis comprising a centerline, said sheet under tension in a longitudinal direction, said face sheet having a face side and a rear side;

b) two side rails mounted on and fixed to said rear side of said face sheet with one said side rail adjacent to each said long edge of said face sheet;

c) brace means for maintaining tension in said face sheet;

d) two end rails mounted on and fixed to said rear side of said face sheet with one said end rail adjacent to each said short edge of said rectangular face sheet; and e) a plurality of cross-ribs mounted on and fixed to said rear side of said face sheet and oriented perpendicular to and in substantially the same plane as said side rails.

14. A panel comprising:

a) a rectangular face sheet having two opposed parallel long edges and two opposed parallel short edges, and a longitudinal y-axis comprising a centerline, said sheet under tension in a longitudinal direction, said face sheet having a face side and a rear side;

b) two side rails mounted on and fixed to said rear side of said face sheet with one said side rail adjacent to each said long edge of said face sheet;

c) brace means for maintaining tension in said face sheet; and d) said face side of said face sheet being slightly convex.

15. A form panel for poured concrete walls comprising:

a) a face sheet having a face side and a rear side;

b) opposing side rails and end rails bounding said face sheet and affixed to said rear side;

c) structural members extending across said rear side between said side rails and end rails and creating a void between said structural members and said face sheet; and d) compression resistant means substantially filling said void for resisting pillowing of said face sheet under said void, said compression resistant means being a honeycomb filling in said void.

16. A panel comprising:

a) a face sheet under tension having a face side and a rear side and at least one boundary edge; and b) at least one brace means for reinforcing said face sheet disposed along and fixed to said rear side of said face sheet proximate to said boundary edge, said reinforcing member being under compression:

c) at least one reinforcing member under compression fixed to said rear side of said face sheet intermediate said boundary edge; and d) a spine reinforcement member under tension fixed to said reinforcing member.

17. A panel comprising:

a) a face sheet under tension having a face side and a rear side and at least one boundary edge; and b) at least one brace means for reinforcing said face sheet disposed along and fixed to said rear side of said face sheet proximate to said boundary edge, said reinforcing member being under compression;

c) at least one reinforcing member under compression fixed to said rear side of said face sheet intermediate said boundary edge; and d) a spine reinforcement member under tension fixed to said rear side of said face sheet.

* * * * *